US006126035A

United States Patent [19]

Schaper et al.

[11] Patent Number: 6,126,035

[45] Date of Patent: Oct. 3, 2000

[54] PLASTIC BEVERAGE CUP WITH INTEGRAL HANDLE AND METHOD OF FORMING PLASTIC BEVERAGE CUP WITH INTEGRAL HANDLE

[75] Inventors: Eric B. Schaper, Midland, Mich.; Jeffrey E. Parker, Lake Bluff, Ill.; Donald A. Tomalia, Jr., Midland; Joseph S. Trombley, Auburn, both of Mich.

[73] Assignee: Packaging Resources Incorporated, Lake Forest, Ill.

[21] Appl. No.: 09/422,713

[22] Filed: Oct. 21, 1999

[51] Int. Cl.[7] ..... B65D 81/24

[52] U.S. Cl. ..... 220/771; 220/254; 220/712; 206/505; 206/519; 264/544

[58] Field of Search ..... 220/771, 773, 220/766, 763, 711, 712, 713, 254; 206/505, 519; 215/396, 397, 398; 264/544, 550, 551, 553, 554

[56] References Cited

U.S. PATENT DOCUMENTS

| | | | |
|---|---|---|---|
| 2,051,940 | 8/1936 | Chichester-Miles . | |
| 2,669,379 | 2/1954 | Olson . | |
| 2,866,575 | 12/1958 | Lattuca . | |
| 2,935,223 | 5/1960 | Crowley . | |
| 3,119,541 | 1/1964 | Lynn . | |
| 3,310,088 | 3/1967 | Hildebrandt et al. . | |
| 3,395,826 | 8/1968 | Belcher et al. | 206/519 |
| 3,441,172 | 4/1969 | Dike | 220/771 X |
| 3,481,501 | 12/1969 | Anderson | 220/771 X |
| 3,620,410 | 11/1971 | Griese, Jr. . | |
| 3,623,633 | 11/1971 | Kinn . | |
| 3,730,382 | 5/1973 | Heisler . | |
| 3,737,069 | 6/1973 | Owen . | |
| 3,889,732 | 6/1975 | Wilkins . | |
| 4,090,660 | 5/1978 | Schram et al. | 220/712 X |
| 4,357,042 | 11/1982 | Gall . | |
| 4,380,304 | 4/1983 | Anderson . | |
| 4,738,373 | 4/1988 | DeParales | 220/254 |
| 4,941,586 | 7/1990 | Tarna . | |
| 5,027,973 | 7/1991 | Drogos . | |
| 5,161,710 | 11/1992 | Chumley . | |
| 5,176,259 | 1/1993 | Andersen . | |
| 5,190,157 | 3/1993 | Przytulla | 206/519 |
| 5,215,210 | 6/1993 | Ostrum et al. . | |
| 5,232,112 | 8/1993 | Howard . | |
| 5,375,719 | 12/1994 | Mittmann et al. | 206/518 |
| 5,490,609 | 2/1996 | Lane et al. | 220/712 |
| 5,520,306 | 5/1996 | Umiker . | |
| 5,617,972 | 4/1997 | Morano et al. | 206/519 X |

*Primary Examiner*—Stephen K. Cronin
*Attorney, Agent, or Firm*—Jenkens & Gilchrist

[57] ABSTRACT

A molded plastic beverage cup comprising a generally cylindrical body portion, a rim and a handle, and a method of forming the cup. The body portion has an open upper end, and the rim extends radially outwardly from the perimeter of the open end of the body portion. The handle is formed as an integral part of the cup. The handle extends outwardly from substantially diametrically opposed portions of the rim and then along the rim on one side of the cup between the diametrically opposed portions. The end portions of the handle extend from the rim, and are sufficiently flexible to allow the handle to be bent upwardly from the rim so that the handle arches diametrically across the upper end of the cup. The entire cup is thermoformed from a single sheet of plastic.

28 Claims, 8 Drawing Sheets

PLASTIC BEVERAGE CUP WITH INTEGRAL HANDLE AND METHOD OF FORMING PLASTIC BEVERAGE CUP WITH INTEGRAL HANDLE

FIELD OF INVENTION

The present invention relates generally to plastic beverage cups and a method of forming the cups. More particularly, the present invention relates to molded plastic beverage cups with integral handles and a method of thermoforming the cups.

BACKGROUND OF THE INVENTION

Conventional single-serve beverages are available at quick serve restaurants in cups small enough to be held with one hand. As the popularity of multi-serve food packages increases, however, the demand for multi-serve beverages also increases. The cups which hold large quantities of fluid, e.g. 64 oz., are difficult for most individuals to grasp with one hand. Accordingly, these large cups are typically provided with separate handles to facilitate carrying the cups. For example, the handle in one prior art embodiment is attached to a ring into which the cup is inserted. The rim of the cup rests on the ring, and a strap connects a lid to the ring. Because the handle and lid are separate from the cup, the cup requires assembly before use.

Handles provided on single-serve cups are typically attached to the side of the cup to hold while drinking. These handles are awkward for carrying a multi-serve cup, and the material used for the handles must be strong enough to carry such large quantities of fluid. In addition, the handle must be positioned to allow the cups to be stacked efficiently to store in quick serve restaurants.

Accordingly, there is a need for a simple design for a stackable disposable cup which is strong enough to carry multi-serve beverages.

SUMMARY OF THE INVENTION

In accordance with one aspect of the present invention, a beverage cup comprises a generally cylindrical body portion, a rim and a handle. The body portion has an open upper end, and the rim extends radially outwardly from the perimeter of the open end of the body portion. The handle is formed as an integral part of the cup. The handle extends outwardly from substantially diametrically opposed portions of the rim and then along the rim on one side of the cup between the diametrically opposed portions. The end portions of the handle extending from the rim are sufficiently flexible to allow the handle to be bent upwardly from the rim so that the handle arches diametrically across the upper end of the cup. The entire cup is thermoformed from a single sheet of plastic.

In accordance with a second aspect of the present invention, a molded plastic beverage cup comprises a generally cylindrical body portion, a rim and a handle. The body portion has an open upper end, and the rim extends radially outwardly from the perimeter of the open end of the body portion. The handle is formed as an integral part of the cup. The handle extends outwardly from substantially diametrically opposed portions of the rim and then along the rim on one side of the cup between the diametrically opposed portions. The end portions of the handle extending from the rim are sufficiently flexible to allow the handle to be bent upwardly from the rim so that the handle arches diametrically across the upper end of the cup. The handle has a substantially U-shaped transverse cross-section along the major portion of its length. The U-shaped cross-section tapers to substantially flat webs at the end portions of the handle extending outwardly from the rim.

In accordance with a third aspect of the present invention, a method of forming a beverage cup comprises the step of thermoforming a single sheet of plastic into a generally cylindrical body portion having an open upper end, a rim extending radially outwardly from the perimeter of the open end of the body portion, and a handle formed as an integral part of the cup. The handle extends outwardly from substantially diametrically opposed portions of the rim and then along the rim on one side of the cup between the diametrically opposed portions. The end portions of the handle extending from the rim are sufficiently flexible to allow the handle to be bent upwardly from the rim so that the handle arches diametrically across the upper end of the cup.

The above summary of the present invention is not intended to represent each embodiment, or every aspect of the present invention. This is the purpose of the figures and detailed description which follow.

BRIEF DESCRIPTION OF THE DRAWINGS

Other objects and advantages of the invention will become apparent upon reading the following detailed description and upon reference to the drawings in which: An.

Figure 1:
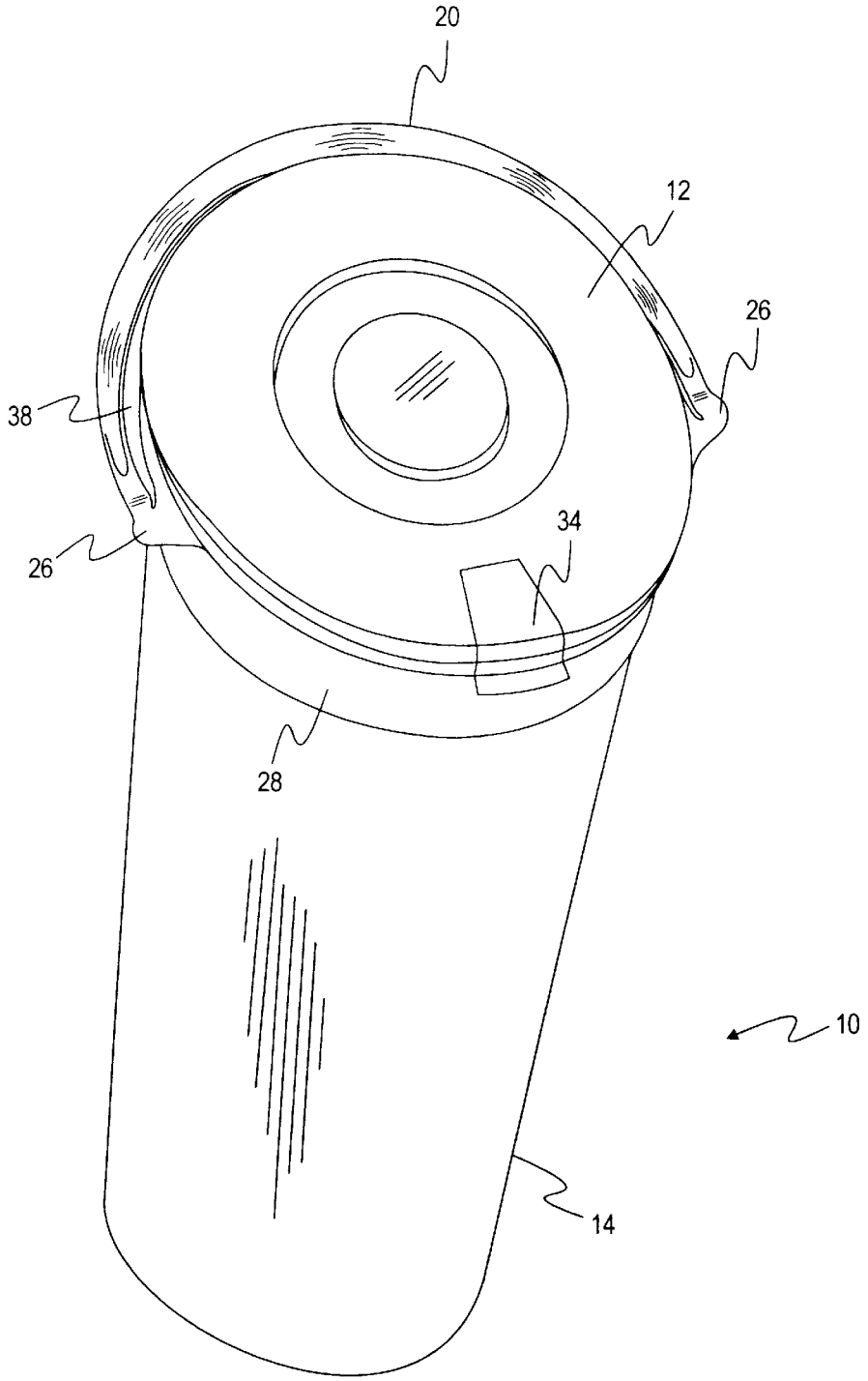
FIG. 1 is a perspective view of a beverage cup with an integral handle in the lowered position where the beverage cup is closed with a lid having a cap locked over a spout, in accordance with the present invention.

While the invention is susceptible to various modifications and alternative forms, a specific embodiment thereof has been shown by way of example in the drawings and will be described in detail. It should be understood, however, that it is not intended to limit the invention to the particular form described, but, on the contrary, the intention is to cover all modifications, equivalents and alternatives falling within the spirit and scope of the invention as defined by the appended claims.

DESCRIPTION OF ILLUSTRATIVE EMBODIMENTS

Figure 2:
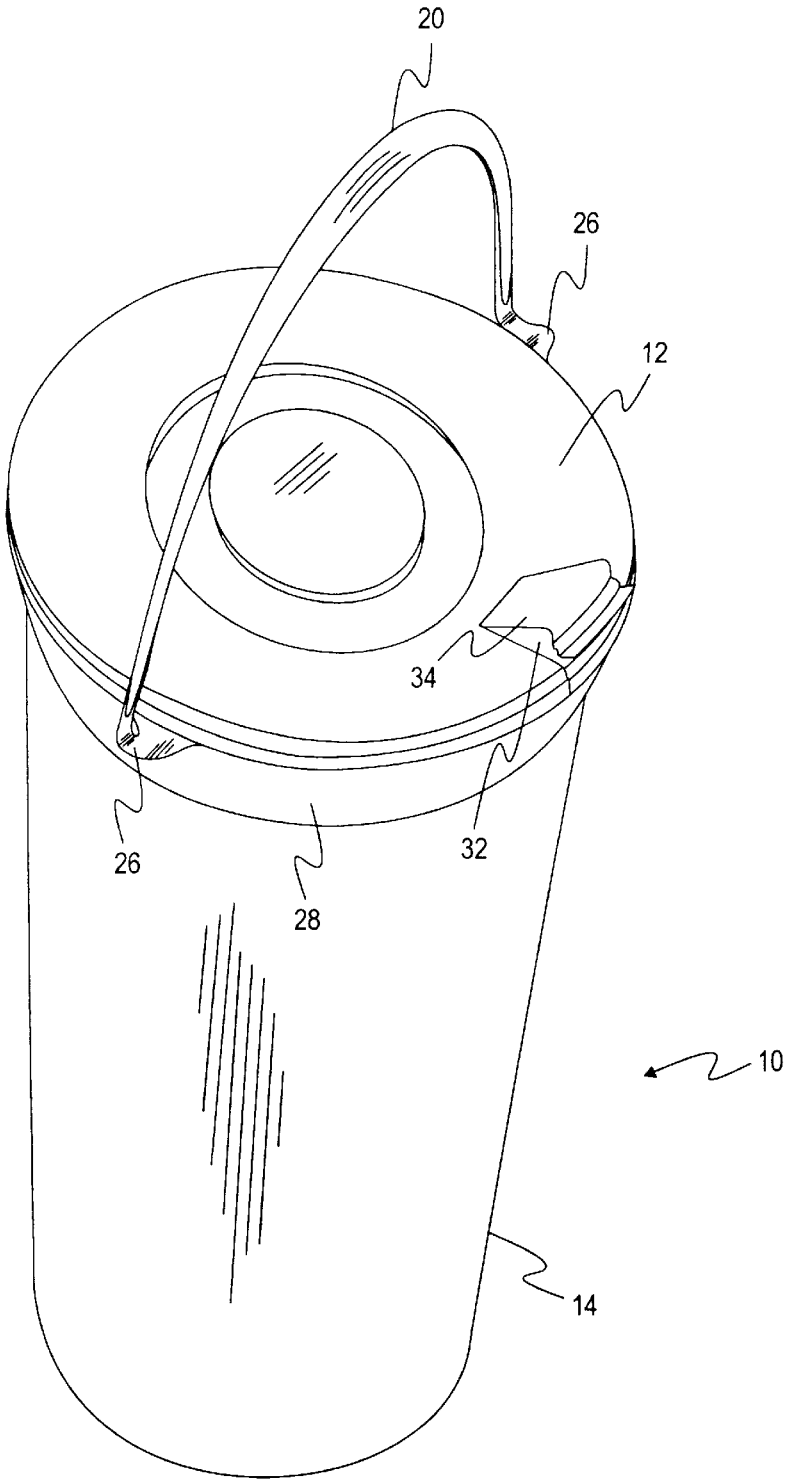
FIG. 2 is a perspective view of the beverage cup and lid of FIG. 1 with the integral handle in the raised position and the cap raised from the spout.

FIGS. 1–2 illustrate a beverage cup 10 closed with a lid 12 in accordance with the present invention. As shown in FIGS. 3–6, the cup 10 includes a generally cylindrical body portion 14 having an open upper end 16, a rim 18 extending radially outwardly from the perimeter of the open end 16, and a handle 20. The handle 20 is formed as an integral part of the cup 10. The handle 20 extends outwardly from substantially diametrically opposed portions 19 of the rim 18 and then along the rim 18 on one side of the cup 10 between the diametrically opposed portions 19.

Figure 4:
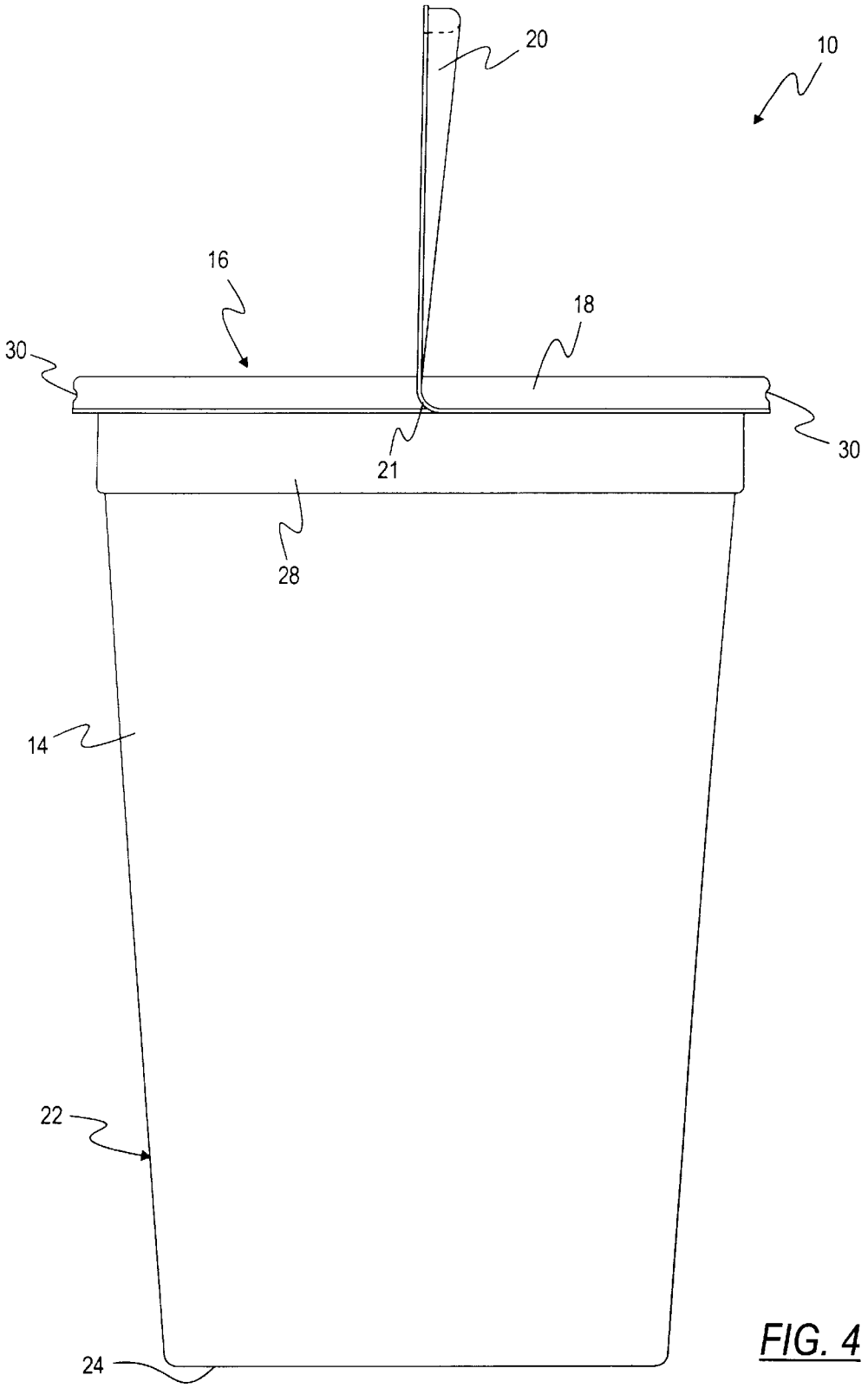
FIG. 4 is a front view of the beverage cup of FIG. 3*a* with the integral handle is in the raised position.
Figure 5:
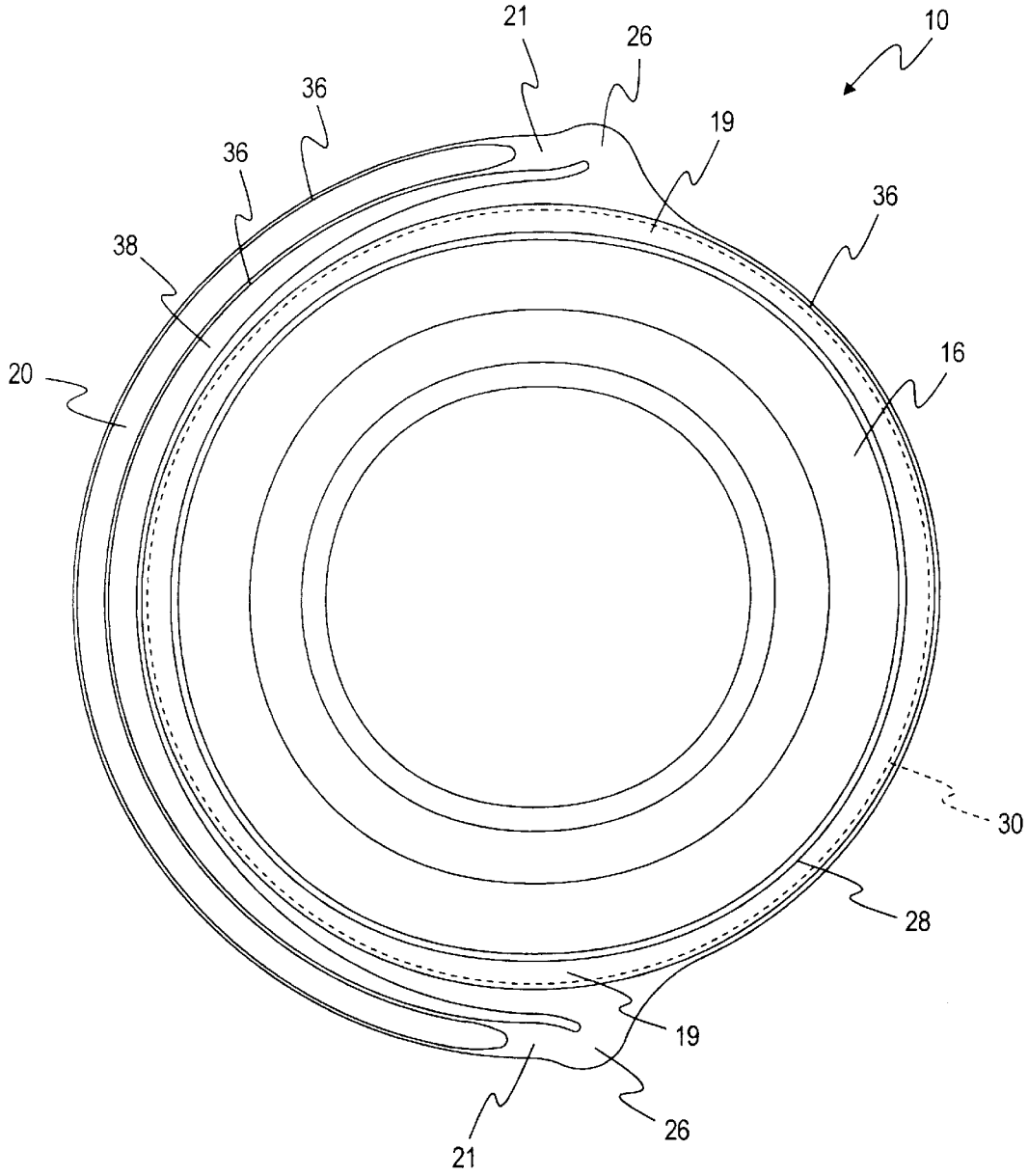
FIG. 5 is a top view of the beverage cup of FIG. 3*a*.
Figure 6:
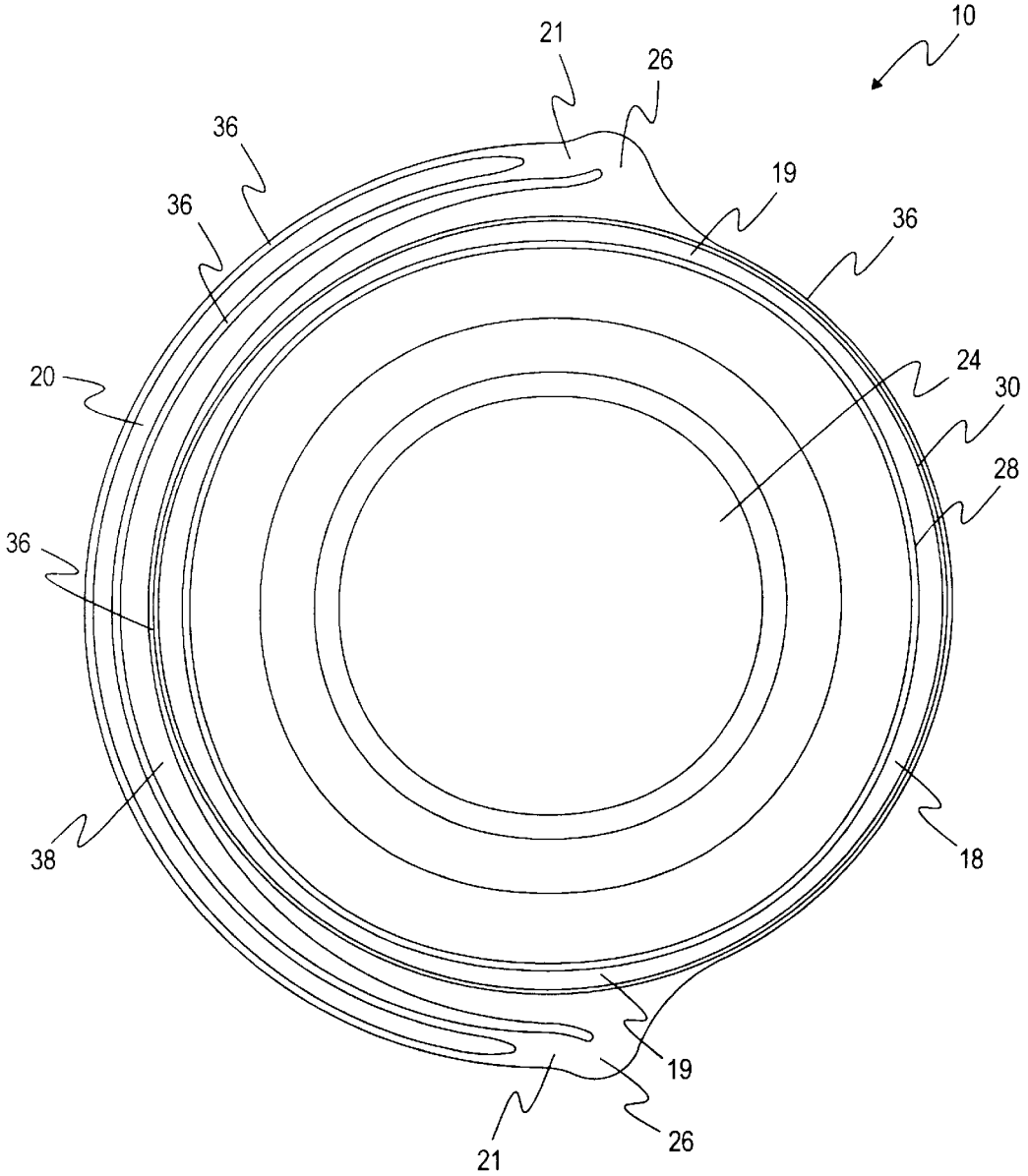
FIG. 6 is a bottom view of the beverage cup of FIG. 3*a*.

The end portions 21 of the handle 20 extending from the rim 18 are sufficiently flexible to allow the handle 20 to be bent upwardly from the rim 18 so that the handle 20 arches diametrically across the upper end of the cup 10, as shown in FIG. 4. The handle 20 has a substantially U-shaped transverse cross-section along the major portion of its length to prevent the handle 20 from cutting into the user's fingers. (See FIGS. 3*b* and 4.) The U-shaped cross-section tapers to substantially flat webs at the end portions 21 of the handle extending outwardly from the rim 18, and the depth of the U-shaped cross-section progressively increases from each end portion 21 of the handle 20 to the center of the handle 20. As exemplified in FIGS. 5 and 6, the handle 20 curves out at points 26 near the attachment to the rim 18 to move the flex point of the handle 20 away from the body portion 14. This prevents the lid 12 from slipping off the cup 10 when the handle 20 is raised.

Figure 3A:
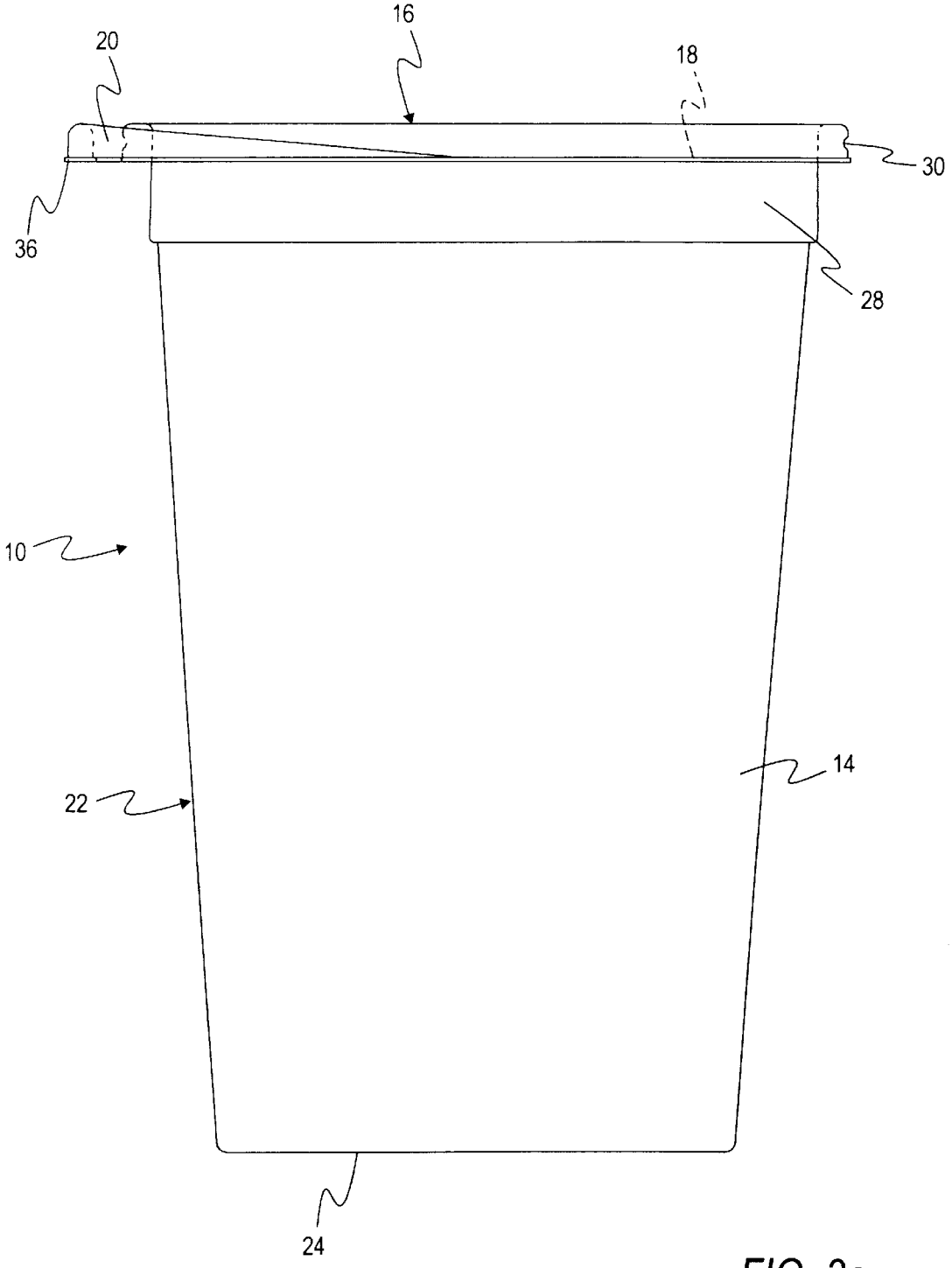
FIG. 3*a* is a front view of a beverage cup with an integral handle in the lowered position, in accordance with the present invention.
Figure 3B:
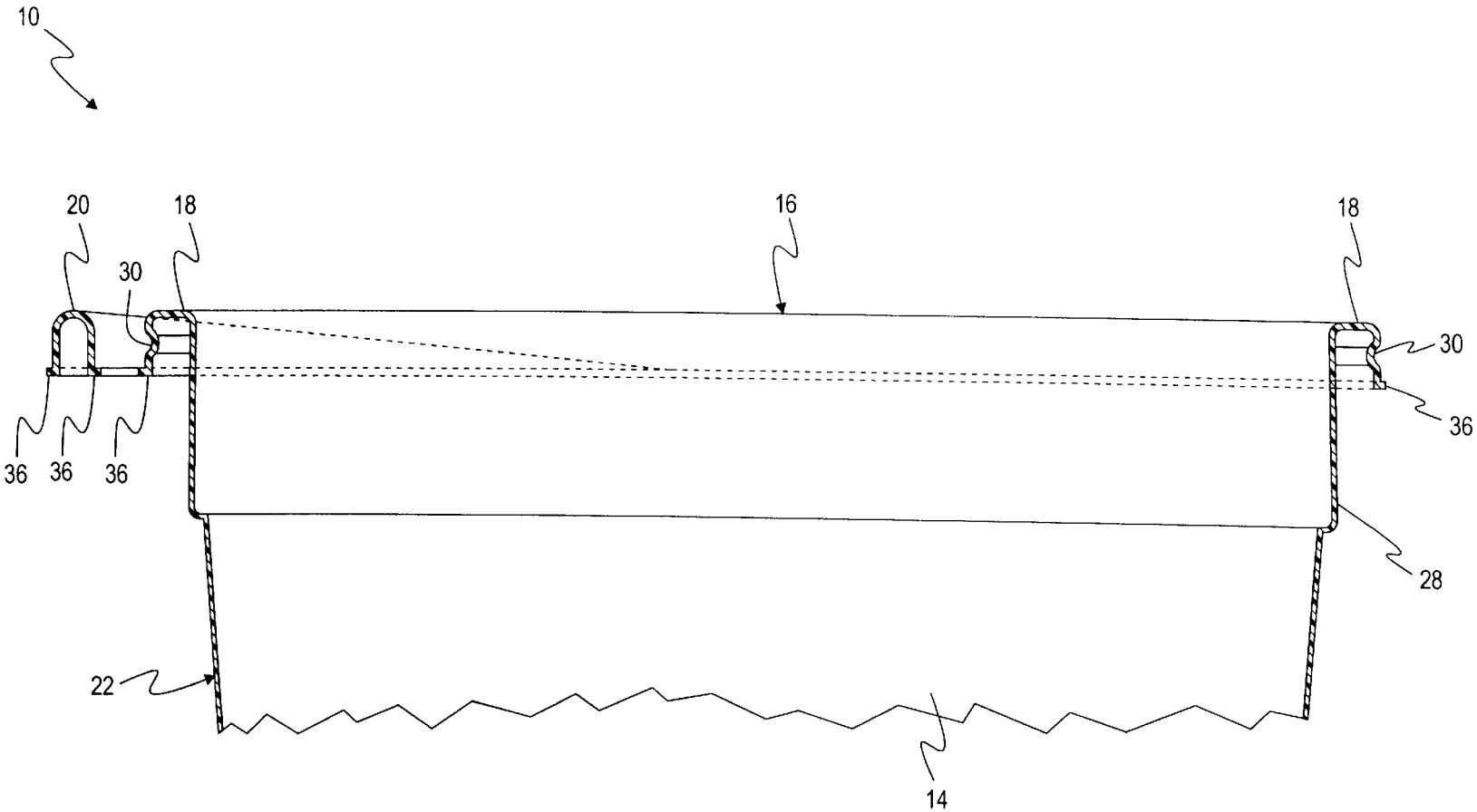
FIG. 3*b* is an exploded cross-sectional front view of the top portion of the beverage cup of FIG. 3*a*.
Figure 7:
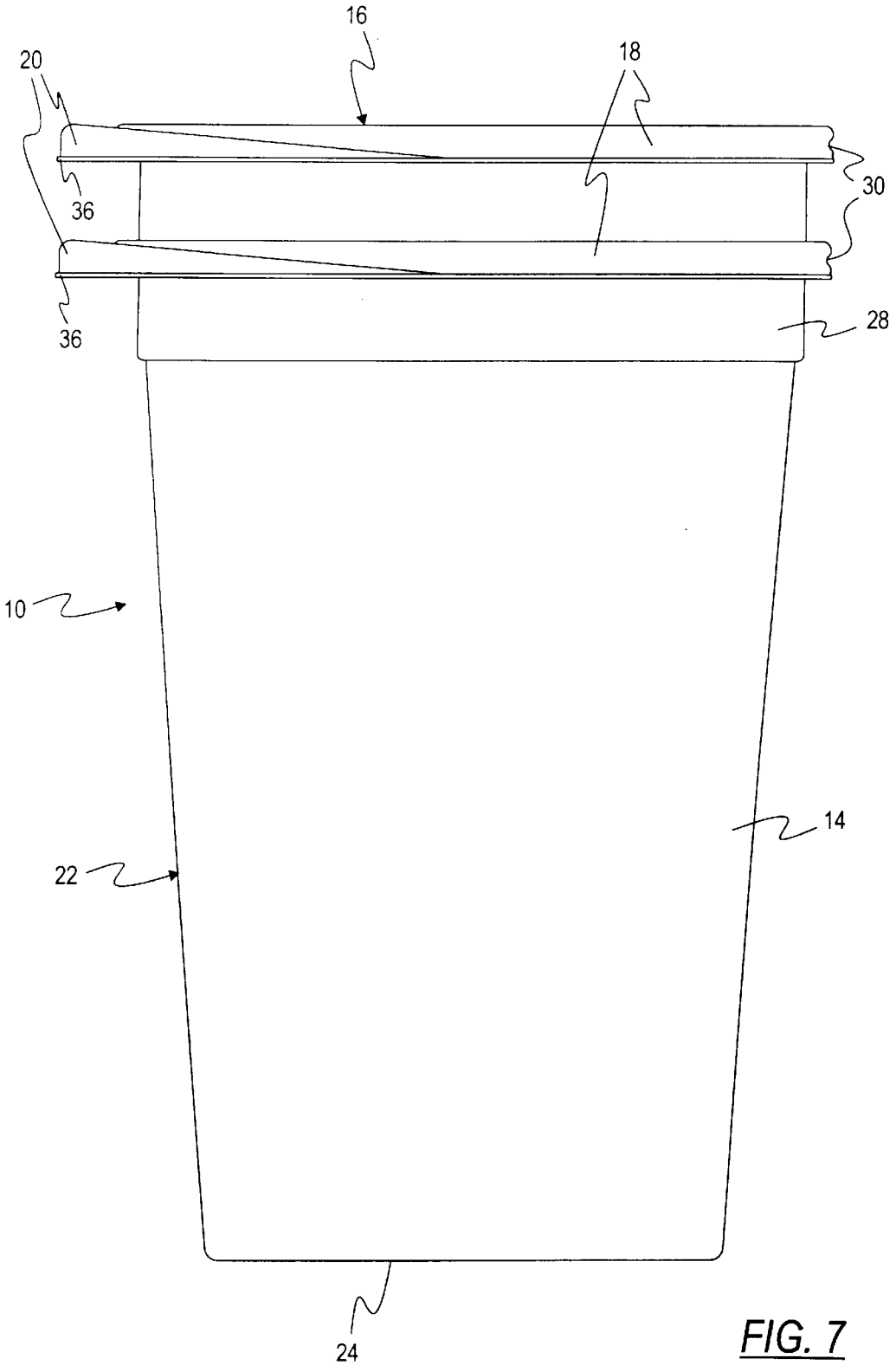
FIG. 7 is a front view of two stacked beverage cups with integral handles in the lowered position, in accordance with the present invention.

The cup 10 is formed by thermoforming a sheet of plastic. Polypropylene is the preferred plastic for the cup 10 due to its suitability for forming living hinges. High-density polyethylene may also be used to form the cup 10; however, high-density polyethylene is not as rigid as polypropylene. Although the body portion 14 is shown with a cylindrical wall 22 and a base 24 closing the bottom of the cylinder, it is contemplated that the body portion 14 may take various other forms. The body portion 14 forms a stacking shoulder 28 extending around the cup 10 below the rim 18, as shown in FIGS. 3, 4 and 7.

The rim 18 includes an intermit 30 along an outer edge of the rim 18. A lug (not shown) on the lid 12 is positioned in the intermit 30 to releasably latch the lid 12 to the cup 10. In an alternate embodiment, the rim 18 may be rolled to allow the lug to lock over the rim to seal the lid 12 onto the cup 10.

The lid 12 may be any conventional cup lid, and is shown in FIG. 1 and 2 as having a spout 32 through which the contents of the cup 10 may be dispensed. A cap 34 is hingedly connected to the lid 12 over the spout 32.

The cup 10 is formed by thermoforming a sheet of plastic and trimming the cup 10 from the remaining sheet of plastic. Thermoforming is a well-known process, which is started by extruding two basic raw materials, polypropylene and white pigment carried in the polypropylene, into a flat sheet. The extrusion process uses heat, pressure, and shearing forces to melt the solid pellets of plastic. During extrusion the plastic is forced, using a rotating screw, down a heated barrel. The plastic changes from solid pellets to molten plastic as it moves down the barrel. From the barrel the molten plastic enters a flat die which sets the basic profile, i.e., thickness and width, of the sheet.

The molten sheet exits the extrusion die, and is immediately run through chrome chill rolls, which cool the plastic to the solid phase. The chrome chill rolls also set the surface finish of the sheet and the final sheet thickness. The surface of the sheet must be smooth if the cup is to have a smooth appearance. Once the solid sheet exits the chrome chill rolls, it is run over the cooling table where the sheet is cooled by ambient air. The sheet is either rolled for thermoforming at a later date, or fed directly into the thermoforming process.

The thermoformer consists of two sections: the ovens and the form station. The polypropylene sheet is intermittently indexed through the thermoformer. The sheet is fed into the ovens and reheated until it is soft, pliable and nearly molten. The thermoformer then indexes the formable sheet into the mold. The mold consists of metal cavities made to the specific shape of the cup.

During molding, the material is first mechanically pushed into the cavities using plugs. One plug is used for each cavity. The material is then pushed by air on what will become the inside of the cup, and pulled by vacuum on what will become the outside of the cup, to the cavity surface. The cavity surface freezes the detail and shape of the cup in place. The mold then retracts from the formed cups, which are still in the sheet web.

The formed web is moved to the trim press where the cups are trimmed from the sheet. A portion of the plastic sheet is removed between the rim 18 and the handle 20 of the cup 10. The entire trimming process occurs in a single plane, which results in narrow flat lips 36 along the trimmed edges. The cutout 38 formed between the rim 18 and the handle 20 narrows at both ends as it approaches the hinge regions, and extends beyond the ends of the U-shaped portion of the handle 20. This facilitates the hinging of the handle 20 in the flat regions 21 at the ends of the handle 20 away from the U-shaped portion. The remaining sheet is mechanically chopped into regrind. The regrind is fed back into the process in the same layer as the HIPS. After trimming, cups are printed off-line in a separate operation.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A beverage cup, comprising:

a generally cylindrical body portion having an open upper end;

a rim extending radially outwardly from the perimeter of the open end of said body portion; and a handle formed as an integral part of the cup and extending outwardly from substantially diametrically opposed portions of said rim and then along said rim on one side of the cup between said diametrically opposed portions, the end portions of said handle extending from said rim being sufficiently flexible to allow said handle to be bent upwardly from said rim so that said handle arches diametrically across the upper end of the cup;

wherein the entire cup is thermoformed from a sheet of plastic.

2. A beverage cup as set forth in claim 1 wherein said handle has a substantially U-shaped transverse cross-section along the major portion of its length, said U-shaped cross-section tapering to substantially flat webs at the end portions of said handle extending outwardly from said rim.

3. A beverage cup as set forth in claim 2 wherein the depth of said substantially U-shaped transverse cross-section progressively increases from each end portion of said handle to the center of said handle.

4. A beverage cup as set forth in claim 1 wherein a portion of said plastic sheet is removed between said rim and said handle.

5. A beverage cup as set forth in claim 1 wherein said body portion forms a stacking shoulder extending around the cup below said rim.

6. A beverage cup as set forth in claim 1 wherein said plastic comprises polypropylene.

7. A beverage cup as set forth in claim 1, further comprising a lid to close said open end of said body portion.

8. A beverage cup as set forth in claim 7 wherein said lid includes a spout through which contents of the cup may be dispensed.

9. A beverage cup as set forth in claim 8, further comprising a cap hingedly connected to said lid over said spout.

10. A beverage cup as set forth in claim 1 wherein said rim includes an intermit along an outer edge of said rim.

11. A molded plastic beverage cup, comprising:

a generally cylindrical body portion having an open upper end;

a rim extending radially outwardly from the perimeter of the open end of said body portion; and a handle formed as an integral part of the cup and extending outwardly from substantially diametrically opposed portions of said rim and then along said rim on one side of the cup between said diametrically opposed portions, the end portions of said handle extending from said rim being sufficiently flexible to allow said handle to be bent upwardly from said rim so that said handle arches diametrically across the upper end of the cup, said handle having a substantially U-shaped transverse cross-section along the major portion of its length, said U-shaped cross-section tapering to substantially flat webs at the end portions of said handle extending outwardly from said rim.

12. A molded plastic beverage cup as set forth in claim 11 wherein the depth of said substantially U-shaped transverse cross-section progressively increases from each end portion of said handle to the center of said handle.

13. A molded plastic beverage cup as set forth in claim 11 wherein the entire cup is formed from a single sheet of plastic, with a portion of said plastic sheet being removed between said rim and said handle.

14. A molded plastic beverage cup as set forth in claim 11 wherein said body portion forms a stacking shoulder extending around the cup below said rim.

15. A molded plastic beverage cup as set forth in claim 11 wherein said plastic comprises polypropylene.

16. A molded plastic beverage cup as set forth in claim 11, further comprising a lid to close said open end of said body portion.

17. A molded plastic beverage cup as set forth in claim 16 wherein said lid includes a spout through which contents of the cup may be dispensed.

18. A molded plastic beverage cup as set forth in claim 17, further comprising a cap hingedly connected to said lid over said spout.

19. A molded plastic beverage cup as set forth in claim 1 wherein said rim includes an intermit along an outer edge of said rim.

20. A method of forming a beverage cup, comprising the step of:

thermoforming a single sheet of plastic into a generally cylindrical body portion having an open upper end, a rim extending radially outwardly from the perimeter of the open end of said body portion, and a handle formed as an integral part of the cup and extending outwardly from substantially diametrically opposed portions of said rim and then along said rim on one side of the cup between said diametrically opposed portions, the end portions of said handle extending from said rim being sufficiently flexible to allow said handle to be bent upwardly from said rim so that said handle arches diametrically across the upper end of the cup.

21. A method as set forth in claim 20, further comprising the step of: trimming said body portion, said rim and said handle from the remaining sheet of plastic.

22. A method as set forth in claim 21 wherein a portion of said plastic sheet is removed between said rim and said handle.

23. A method as set forth in claim 21 wherein said trimming step occurs in a plane.

24. A method as set forth in claim 20 wherein said handle has a substantially U-shaped transverse cross-section along the major portion of its length, said U-shaped cross-section tapering to substantially flat webs at the end portions of said handle extending outwardly from said rim.

25. A method as set forth in claim 24 wherein the depth of said substantially U-shaped transverse cross-section progressively increases from each end portion of said handle to the center of said handle.

26. A method as set forth in claim 20 wherein said body portion forms a stacking shoulder extending around the cup below said rim.

27. A method as set forth in claim 20 wherein said plastic comprises polypropylene.

28. A method as set forth in claim 20 wherein said rim includes an intermit along an outer edge of said rim.

* * * * *